US008047538B2

(12) United States Patent
Katsura et al.

(10) Patent No.: US 8,047,538 B2
(45) Date of Patent: Nov. 1, 2011

(54) SHEET TRANSPORT APPARATUS AND IMAGE FORMING APPARATUS PROVIDED WITH THE SAME

(75) Inventors: Norichika Katsura, Osaka (JP); Toshiki Ohgita, Osaka (JP); Yasuaki Fukada, Osaka (JP); Yoshiyuki Kobayashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 20 days.

(21) Appl. No.: 12/537,344

(22) Filed: Aug. 7, 2009

(65) Prior Publication Data

US 2010/0044950 A1 Feb. 25, 2010

(30) Foreign Application Priority Data

Aug. 25, 2008 (JP) ..... 2008-215594

(51) Int. Cl.
*B65H 9/04* (2006.01)

(52) U.S. Cl. ..... 271/242; 271/245

(58) Field of Classification Search ..... 271/227, 271/242, 226, 245
See application file for complete search history.

(56) References Cited

U.S. PATENT DOCUMENTS 5,308,054 A * 5/1994 Sugito ..... 271/9.09
5,482,265 A * 1/1996 Nakazato et al. ..... 271/242
5,543,909 A * 8/1996 Quesnel ..... 399/394
5,738,349 A * 4/1998 Shirasaki ..... 271/242
5,904,350 A * 5/1999 Creighton et al. ..... 271/227
2003/0085505 A1* 5/2003 Inoue et al. ..... 271/10.01
2003/0146566 A1* 8/2003 Aizawa ..... 271/242
2005/0189707 A1* 9/2005 Sano et al. ..... 271/242
2006/0022400 A1* 2/2006 Kawasaki et al. ..... 271/227

FOREIGN PATENT DOCUMENTS

JP 63-185749 8/1988
JP 06-087550 3/1994

* cited by examiner

*Primary Examiner* — Kaitlin Joerger
*Assistant Examiner* — Patrick Cicchino
(74) *Attorney, Agent, or Firm* — Renner, Otto, Boisselle & Sklar, LLP

(57) ABSTRACT

In one embodiment of the present invention, a sheet transport apparatus is provided with a registration roller, a sheet transport path, a first optical sensor, a second sensor that detects the presence or absence of a sheet at an upstream side of the first optical sensor in a sheet transportation direction Xd, and a sheet transportation control unit that stops the driving of the registration roller after an elapse of a transportation time after the detection of sheet absence following sheet presence by the first optical sensor, wherein the sheet transportation control unit does not perform control with sheet detection by the first optical sensor within a detection restricted time after predetermined sheet detection by the second sensor when the sheet is of a specific type.

4 Claims, 7 Drawing Sheets

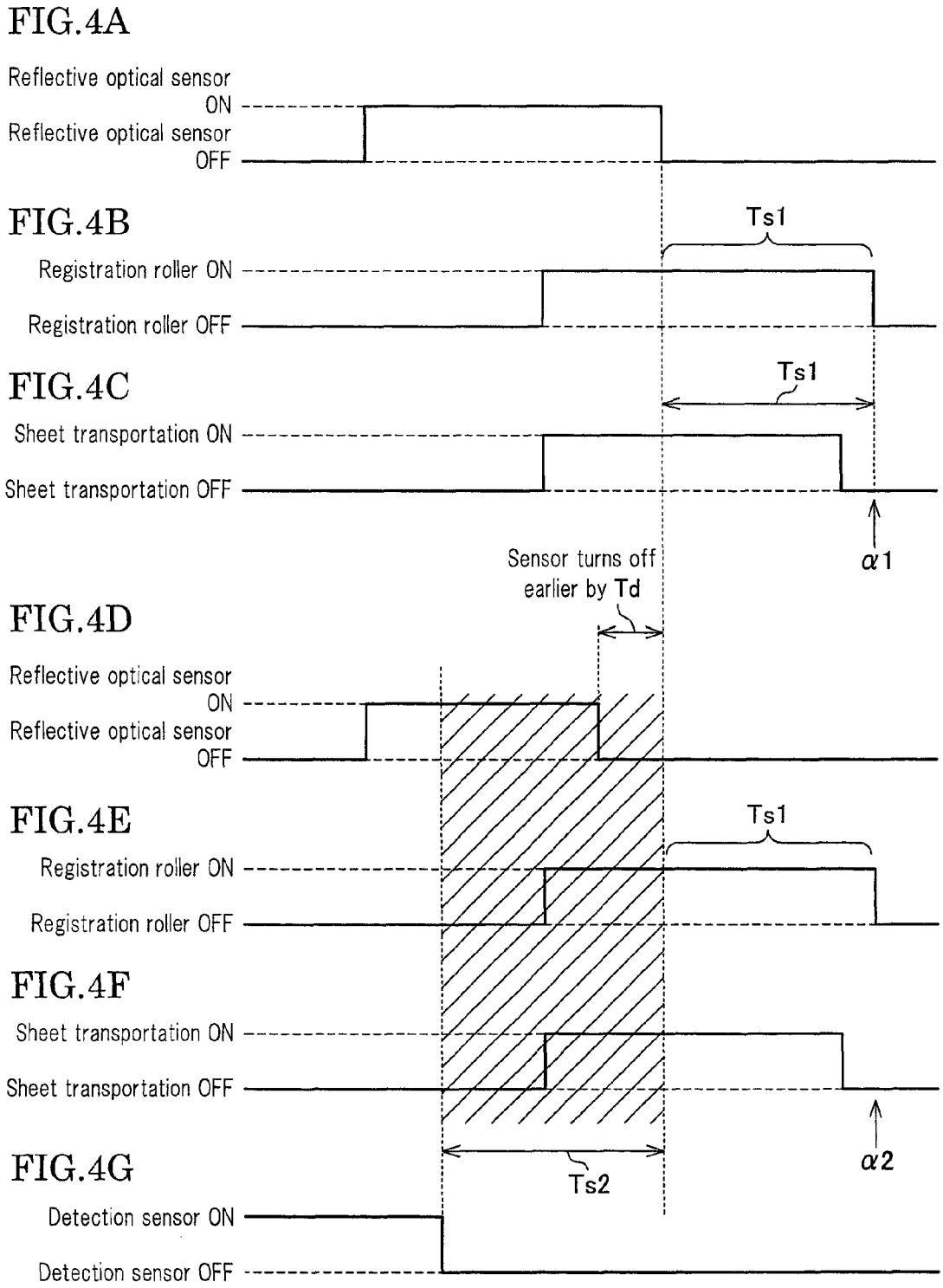
FIG.4A
Reflective optical sensor ON
Reflective optical sensor OFF
FIG.4B
Ts1
Registration roller ON
Registration roller OFF
FIG.4C
Ts1
Sheet transportation ON
Sheet transportation OFF
α1
Sensor turns off earlier by Td
FIG.4D
Reflective optical sensor ON
Reflective optical sensor OFF
FIG.4E
Ts1
Registration roller ON
Registration roller OFF
FIG.4F
Sheet transportation ON
Sheet transportation OFF
α2
Ts2
FIG.4G
Detection sensor ON
Detection sensor OFF

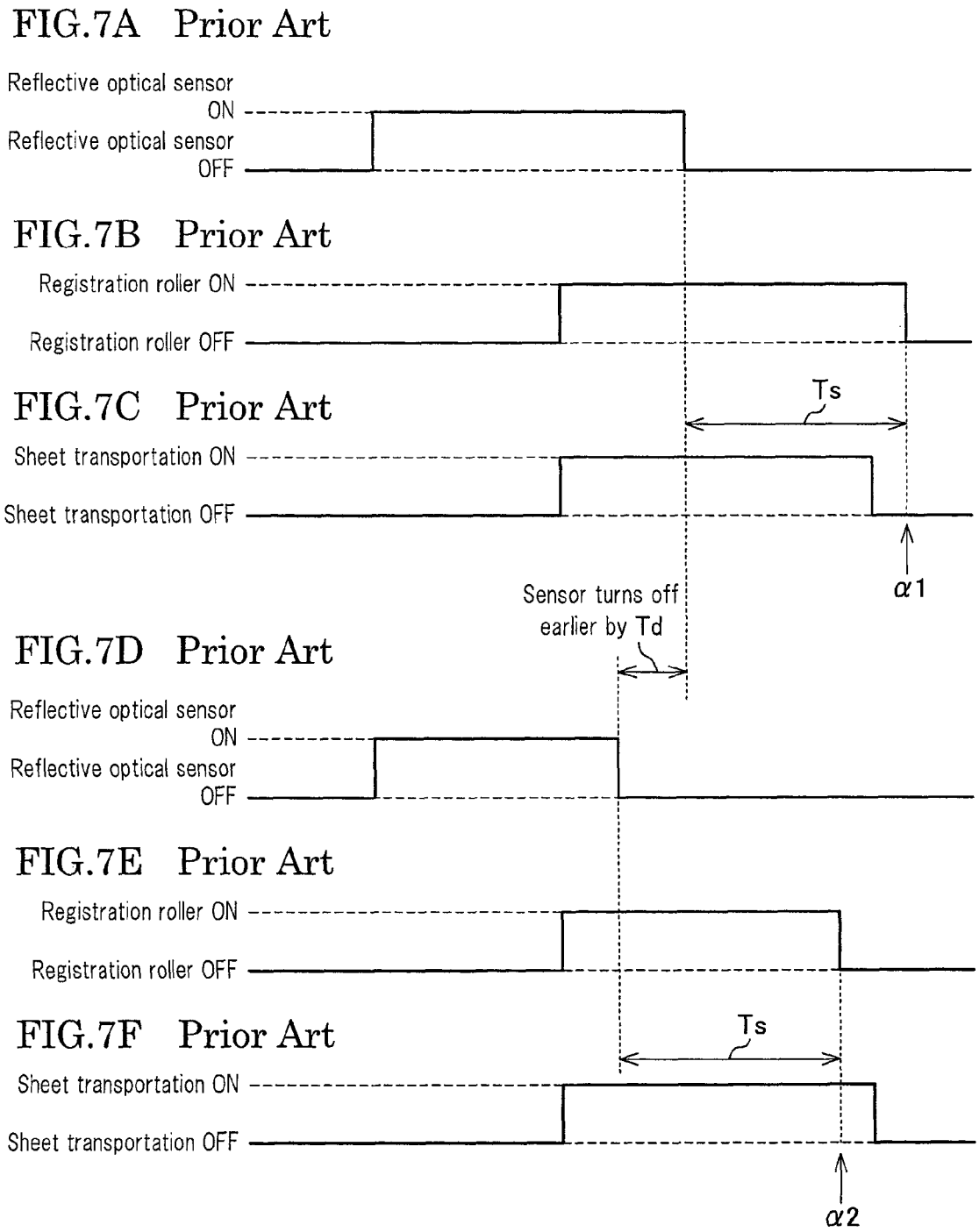
FIG.7A Prior Art
Reflective optical sensor ON
Reflective optical sensor OFF
FIG.7B Prior Art
Registration roller ON
Registration roller OFF
FIG.7C Prior Art
Ts
Sheet transportation ON
Sheet transportation OFF
α1
Sensor turns off earlier by Td
FIG.7D Prior Art
Reflective optical sensor ON
Reflective optical sensor OFF
FIG.7E Prior Art
Registration roller ON
Registration roller OFF
FIG.7F Prior Art
Ts
Sheet transportation ON
Sheet transportation OFF
α2

SHEET TRANSPORT APPARATUS AND IMAGE FORMING APPARATUS PROVIDED WITH THE SAME

BACKGROUND OF THE INVENTION

This application claims priority under 35 U.S.C. §119(a) on Patent Application No. 2008-215594 filed in Japan on Aug. 25, 2008, the entire contents of which are herein incorporated by reference.

The present invention relates to a sheet transport apparatus in which the presence or absence of a sheet is detected by an optical sensor at a curved portion in a sheet transport path, which is curved at an upstream side in the sheet transportation direction of a registration roller that transports sheets, and driving of the registration roller is stopped after an elapse of a predetermined transportation time from detection by the optical sensor of sheet absence following sheet presence of a sheet transported by the registration roller; and an image forming apparatus provided with the sheet transport apparatus.

For example, in electrophotographic image forming apparatuses, generally, an electrostatic latent image is formed on the surface of an image carrier such as a photosensitive drum; a toner image is formed on the surface of the image carrier by developing the electrostatic latent image on the surface of the image carrier using a developer; the toner image is transferred from the image carrier to a sheet such as plain paper or an OHP sheet while the sheet sandwiched in a nip region between the image carrier and a transfer member is being transported; and the sheet is heated and pressed, thereby fixing the toner image on the sheet. There is also a case where the toner image is transferred temporarily from the image carrier to an intermediate transfer body, and the toner image is fixed on the sheet after transferring the toner image on the intermediate transfer body from the intermediate transfer body to the sheet.

In such image forming apparatuses, a sheet transport apparatus is incorporated, and the sheet is drawn out from a paper feeding unit such as a paper feeding tray and transported by such a sheet transport apparatus. Although it is more preferable that the sheet transport path is straight in the sheet transport apparatus, in many cases, the sheet transport path cannot be kept straight and is curved at a plurality of positions because of the positional relationship between constituent members such as the paper feeding tray and the photosensitive drum.

Furthermore, in the transport path of the sheet transport apparatus, a registration roller (also called PS (Paper Stop) roller) is provided at an upstream side in the sheet transportation direction of the nip region between the image carrier and the transfer member or the nip region between the intermediate transfer body and the transfer member, and the leading edge (downstream side edge in the sheet transportation direction) of the sheet is put against the registration roller that is in a stopped state so as to flex the sheet so that the leading edge of the sheet is arranged in parallel to the registration roller due to the flexibility of the sheet, thereby transporting the sheet to the nip region by the registration roller. This prevents the sheet from obliquely passing through the nip region, avoiding oblique transfer of the toner image onto the sheet.

Meanwhile, after a sheet has passed through the registration roller, it is necessary that rotational driving of the registration roller is stopped before the next sheet arrives at the registration roller to put the leading edge of the next sheet against the registration roller so that the sheet flexes, but, in many cases, the rotational driving of the registration roller is stopped by the detection of the presence or absence of a sheet at an upstream side of the registration roller in the sheet transportation direction. An optical sensor is sometimes used as a means for detecting the presence or absence of a sheet. In a sheet transport apparatus using an optical sensor, rotational driving of the registration roller is temporarily stopped after an elapse of a predetermined transportation time from detection of the trailing edge (upstream side edge in the sheet transportation direction) of the sheet by an optical sensor so as to be ready to transport the next sheet. The predetermined transportation time is at least the time for the trailing edge of the sheet to pass through a post-detection transportation distance, i.e., from a sheet trailing edge detection point to the registration roller, and can be obtained in advance from the post-detection transportation distance and the sheet transportation speed.

Meanwhile, when the presence or absence of a sheet transported by the registration roller is detected by an optical sensor in a sheet transport apparatus provided with a sheet transport path that is curved at an upstream side with respect to the registration roller in the sheet transportation direction, variation in sheet characteristics such as sheet stiffness and optical characteristics is not preferable in that the time of the detection of the sheet trailing edge by the optical sensor may differ. This is further described with reference to FIGS. 6A and 6B, using an example where a reflective optical sensor that detects the presence or absence of a sheet based on reflected light, that is light applied to a sheet being transported and reflected from the sheet, is used as the optical sensor.

FIGS. 6A and 6B are diagrams illustrating the inconveniences in the case where a reflective optical sensor 102 is used in a conventional sheet transport apparatus provided with a sheet transport path S that is curved at an upstream side of a registration roller 101 in the sheet transportation direction. FIG. 6A illustrates a detection state by the reflective optical sensor 102 when a plain paper Q1 is transported, and FIG. 6B illustrates a detection state by the reflective optical sensor 102 when an OHP sheet Q2 which is stiffer than the plain paper is transported.

The conventional sheet transport apparatus shown in FIGS. 6A and 6B is provided with the registration roller 101 that transports the sheets Q1 and Q2, the sheet transport path S including a curved portion 71 that is curved at an upstream side of the registration roller 101 in the sheet transportation direction (the direction of arrow Xd in the figure), and the reflective optical sensor 102 that detects the presence or absence of the sheets Q1 and Q2 at the curved portion 71 of the sheet transport path S; and rotational driving of the registration roller 101 is temporarily stopped after an elapse of a predetermined transportation time from the detection by the reflective optical sensor 102 of sheet absence following sheet presence of the sheets Q1 and Q2 transported by the registration roller 101 so as to be ready to transport the next sheet. In this sheet transport apparatus, trailing edges Q1*d* and Q2*d* of the sheets Q1 and Q2 are determined by monitoring the non-detection of reflected light R1 and R2 that is incident on the reflective optical sensor 102.

The registration roller 101 is rotationally driven around the axis in the sheet transportation direction (direction of arrow X in the figure) while sandwiching the sheets Q1 and Q2 between the registration roller 101 and a facing roller (here, an idler roller) 105 facing the registration roller 101, so as to transport the sheets Q1 and Q2.

The reflective optical sensor 102 is provided outside the curved portion 71 of the sheet transport path S, and is made up of a light-emitting unit 102*a* including a light-emitting element that applies outgoing light L onto the sheets Q1 and Q2 transported by the registration roller 101, and a light-receiving unit 102*b* including a light-receiving element that receives the reflected light R1 and R2 reflected from the sheets Q1 and Q2.

In the conventional sheet transport apparatus thus configured, there is a difference in detection time by the sensor 102, i.e., the detection time by the sensor 102 determined by the trailing edge Q1*d* of the plain paper Q1 passing through a light-application region of the reflective optical sensor 102 during the transportation of the plain paper Q1 (as shown in FIG. 6A), and the detection time by the sensor 102 determined by the trailing edge Q2*d* of the OHP sheet Q2 passing through the light-application region of the reflective optical sensor 102 during the transportation of the OHP sheet Q2 (as shown in FIG. 6B).

To be specific, the incoming direction of the reflected light R1, that is outgoing light L applied by the light-emitting unit 102*a* to the plain paper Q1 toward the trailing edge Q1*d* and reflected from the plain paper Q1, to the light-receiving unit 102*b* (ref: FIG. 6A) is substantially constant, whereas the outgoing light L applied from the light-emitting unit 102*a* onto the OHP sheet Q2 toward the trailing edge Q2*d* (ref: FIG. 6B) may be easily transmitted through the OHP sheet Q2 (ref: Ld in FIG. 6B), and the incoming direction of the reflected light R2 reflected from the OHP sheet Q2 to the light-receiving unit 102*b* may greatly deviate, because the trailing edge Q2*d* easily flips up due to the higher degree of stiffness compared with plain paper Q1. In that case, because the reflected light R2 from the OHP sheet Q2 does not enter the light-receiving unit 102*b* before the trailing edge Q2*d* of the OHP sheet Q2 has arrived (downstream side in the sheet transportation direction Xd), the reflective optical sensor 102 falsely detects that the trailing edge Q2*d* has passed (detects at a time earlier than the detection time for the plain paper Q1) before the trailing edge Q2*d* of the OHP sheet Q2 passes through.

FIGS. 7A to 7F are timing charts illustrating detection timings for the sheets Q1 and Q2 by the reflective optical sensor 102, a start/stop timing for the rotational driving of the registration roller 101, and transportation timings for the sheets Q1 and Q2 by the registration roller 101 of the conventional sheet transport apparatus. FIGS. 7A to 7C illustrate timing charts for the case where the plain paper Q1 is transported, and FIGS. 7D to 7F illustrate timing charts for the case where the OHP sheet Q2 is transported. In FIGS. 7A to 7F, the reference letters Ts show a predetermined transportation time from the point where a change from sheet-present detection to sheet-absent detection is detected by the reflective optical sensor 102 to the stop of rotational driving of the registration roller 101. Furthermore, in FIGS. 7A to 7F, "reflective optical sensor ON" and "reflective optical sensor OFF" for the reflective optical sensor 102 illustrate "detection state—present" and "detection state—absent", respectively, for the sheets Q1 and Q2; "registration roller ON" and "registration roller OFF" illustrate a "driving state" and a "driving stopped state", respectively, of the registration roller; and "sheet transportation ON" and "sheet transportation OFF" illustrate a "transporting state" and a "non-transporting state" of the sheets Q1 and Q2 by the registration roller 101, respectively. The same applies for FIGS. 4A to 4G to be mentioned later.

When transporting the plain paper Q1 in the conventional sheet transport apparatus, as shown in FIGS. 7A to 7C, after the plain paper Q1 is transported by the registration roller 101 (after the trailing edge Q1*d* of the plain paper Q1 has passed through the registration roller 101), rotational driving of the registration roller stops (ref: $\alpha$1 in the figure). On the other hand, when transporting the OHP sheet Q2, if false detection by the reflective optical sensor 102 occurs as shown in FIG. 6B, rotational driving of the registration roller stops (ref: $\alpha$2) while the OHP sheet Q2 is still being transported by the registration roller 101 (before the trailing edge Q2*d* of the OHP sheet Q2 passes through the registration roller 101) as shown in FIGS. 7D to 7F.

Thus, in the conventional sheet transport apparatus, if false detection by the reflective optical sensor 102 occurs, it is determined that the trailing edge Q2*d* of the OHP sheet Q2 has passed through the registration roller 101 even if the OHP sheet Q2 is still being transported by the registration roller 101, and driving of the registration roller 101 is stopped while the OHP sheet Q2 is still being transported by the registration roller 101. At this time, if the OHP sheet Q2 has arrived at the nip region between the image carrier and the transfer member or the nip region between the intermediate transfer body and the transfer member, the registration roller 101 whose driving has been stopped while the OHP sheet Q2 is still being transported is forcefully rotated by the OHP sheet Q2, and a transportation load is applied to the OHP sheet Q2, and therefore pulling the OHP sheet Q2, thereby possibly causing image defects such as a dislocated transfer.

On the other hand, JP H6-87550A discloses a configuration in which a transmissive optical sensor is disposed so that its optical axis achieves a predetermined angle with respect to the sheet transportation face; however, in the case where the transmissive optical sensor is used in the sheet transport apparatus instead of the above-described reflective optical sensor as well, because the angle of the optical axis of the transmissive optical sensor with respect to the sheet transportation face differs depending on the characteristics of the sheet such as stiffness, as in the case of the sheet transport apparatus provided with the above-described reflective optical sensor, there is a possibility of images defects being caused such as dislocated transfer due to the occurrence of false detection of the trailing edge of the sheet.

Such inconveniences become particularly notable when the detection is performed by the optical sensor at a sheet flection forming portion (ref: reference numeral 75 in FIGS. 6A and 6B) for reliably flexing the sheet so as to arrange the leading edge of the sheet in parallel to the registration roller.

SUMMARY OF THE INVENTION

Thus, an object of the present invention is to provide a sheet transport apparatus in which the presence or absence of a sheet is detected by an optical sensor at a curved portion in a sheet transport path, which is curved at an upstream side in the sheet transportation direction of a registration roller that transports sheets, and driving of the registration roller is stopped after an elapse of a predetermined transportation time from detection by the optical sensor of sheet absence following sheet presence of a sheet transported by the registration roller, and in which stopping of the driving of the registration roller while the sheet is still being transported by the registration roller can be prevented; and an image forming apparatus provided with the sheet transport apparatus.

To solve the above problem, the present invention provides a sheet transport apparatus including: a registration roller that transports a sheet in a predetermined sheet transportation direction, a sheet transport path including a curved portion that is curved at an upstream side of the registration roller in the sheet transportation direction, a first optical sensor that detects the presence or absence of a sheet at the curved portion of the sheet transport path, a second sensor that detects the presence or absence of a sheet at an upstream side of the first optical sensor in the sheet transportation direction, and a sheet transportation control unit that stops the driving of the registration roller after an elapse of a predetermined transportation time from detection by the first optical sensor of sheet absence following sheet presence of a sheet transported by the registration roller, wherein the sheet transportation control unit does not perform control with sheet detection by the first optical sensor within a predetermined detection restricted time from after predetermined sheet detection by the second sensor when the sheet is of a specific type; and an image forming apparatus provided with the sheet transport apparatus.

According to the sheet transport apparatus and the image forming apparatus of the present invention, even if the first optical sensor may falsely detect the trailing edge of the sheet depending on the type of the sheet (for example, an OHP sheet which is stiffer than normal plain paper), the sheet transportation control unit does not perform control with sheet detection by the first optical sensor when the sheet is of a particular type (for example, OHP sheet) within the predetermined detection restricted time after the predetermined sheet detection by the second sensor and, therefore, the detection of sheet absence following sheet presence by the first optical sensor can be ignored (masked) in the detection restricted time. That is, the sheet transportation control unit can ignore false detection, i.e., detection of the passing of a trailing edge before the trailing edge of a particular type of sheet passes through, by the first optical sensor. Therefore, stopping of the driving of the registration roller while the sheet is still being transported by the registration roller can be prevented and, thus, image defects such as dislocated transfer can be avoided.

The notion of "does not perform control with sheet detection by the first optical sensor" includes the control of not performing sheet detection itself by the first optical sensor, the control of performing sheet detection by the first optical sensor but not monitoring the sheet detection, and the control of monitoring of the sheet detection by the first optical sensor but not assessing the sheet detection.

For the predetermined sheet detection by the second sensor, an example may be given of the detection of sheet absence following sheet presence by the second sensor.

As described above, the present invention can provide a sheet transport apparatus in which the presence or absence of a sheet is detected by an optical sensor at a curved portion in a sheet transport path, which is curved at an upstream side in the sheet transportation direction of a registration roller that transports sheets, and driving of the registration roller is stopped after an elapse of a predetermined transportation time from detection by the optical sensor of sheet absence following sheet presence of a sheet transported by the registration roller, and in which stopping of the driving of the registration roller while the sheet is still being transported by the registration roller can be prevented and image defects such as dislocated transfer can be avoided; and an image forming apparatus provided with the sheet transport apparatus.

BRIEF DESCRIPTION OF THE DRAWINGS

FIGS. 4A to 4G are timing charts illustrating a detection timing for a recording sheet by a reflective optical sensor and a detection sensor, a start/stop timing for the rotational driving of the registration roller, and a transportation timing for the recording sheet by the registration roller of the sheet transport apparatus according to an embodiment of the present invention; FIGS. 4A to 4C are diagrams illustrating timing charts for the case where a plain paper is transported; and FIGS. 4D to 4G are diagrams illustrating timing charts for the case where an OHP sheet is transported.

FIG. 6A is a diagram illustrating a detection state of the reflective optical sensor when plain paper is transported; and FIG. 6B is a diagram illustrating a detection state of the reflective optical sensor when an OHP sheet, which is stiffer than plain paper, is transported.

FIGS. 7A to 7F are timing charts illustrating a detection timing for a sheet by a reflective optical sensor, the start/stop timing for the rotational driving of the registration roller, and a transportation timing for the sheet by the registration roller of the conventional sheet transport apparatus; FIGS. 7A to 7C are diagrams illustrating timing charts for the case where plain paper is transported; and FIGS. 7D to 7F are diagrams illustrating timing charts for the case where an OHP sheet is transported.

DESCRIPTION OF THE PREFERRED EMBODIMENTS

Hereinafter, an embodiment according to the present invention is described with reference to the drawings. The following embodiment is a specific example of the present invention, and is not of a nature limiting the technological scope of the present invention.

Figure 1:
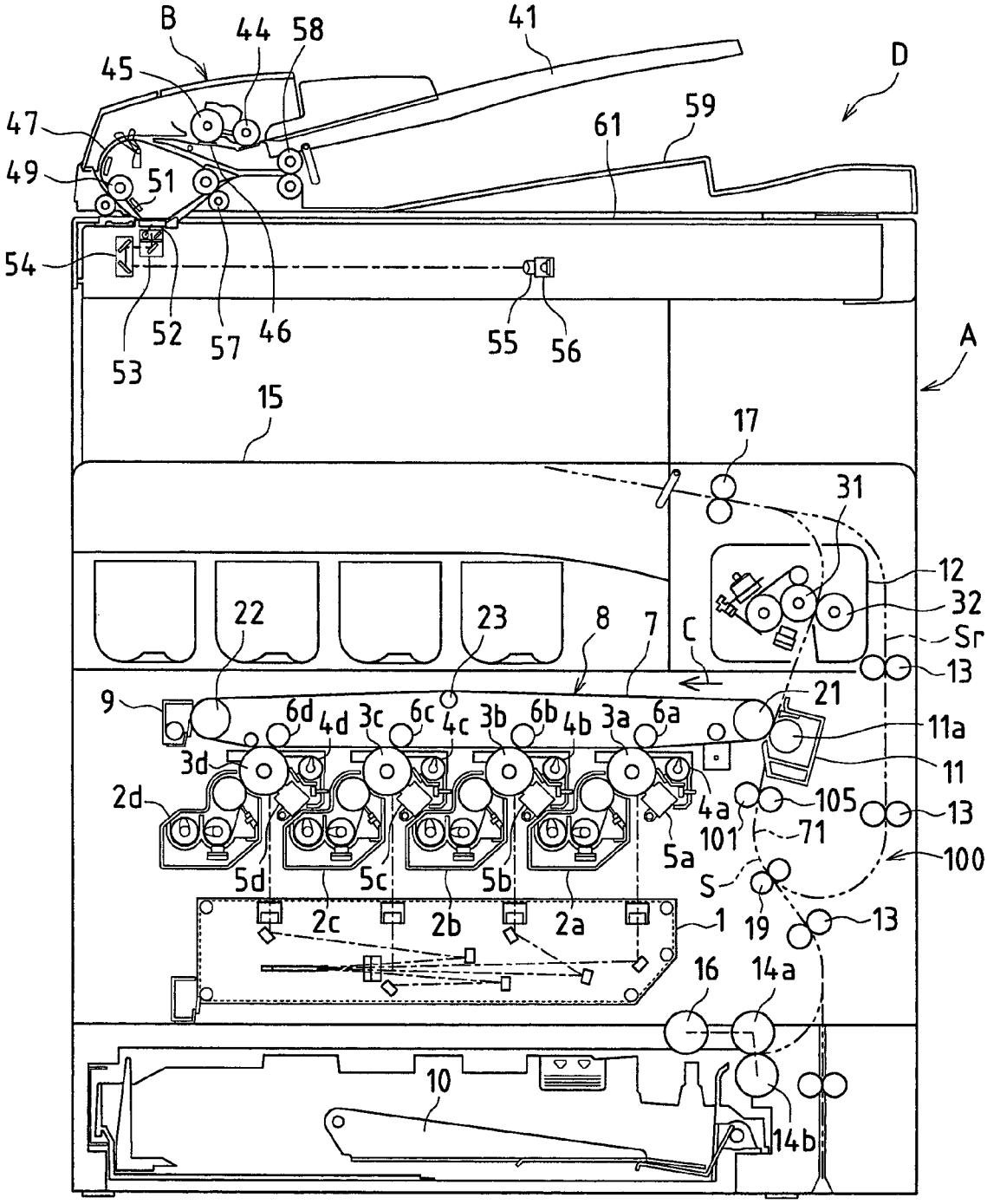
FIG. 1 is a side view illustrating an image forming apparatus in which an embodiment of the sheet transport apparatus of the present invention is applied.

FIG. 1 is a side view schematically illustrating an image forming apparatus D in which an embodiment of the sheet transport apparatus of the present invention is applied. The image forming apparatus D is provided with an original reading apparatus B that reads images of the original, and an apparatus main unit A that records and forms the images of the original read by the original reading apparatus B or images received from outside on recording sheets such as plain paper and OHP sheets (examples of sheets) in color or monochrome.

In the original reading apparatus B, when an original is set onto an original set tray 41, a pickup roller 44 is pressed against the surface of the original and rotated; the original is drawn out from the tray 41; and the original is transported to a transport path 47 after passing through between a handling roller 45 and a separation pad 46 and being separated into individual sheets of paper.

In the transport path 47, the leading edge of the original abuts registration rollers 49 so that the leading edge of the original and the registration rollers 49 are arranged in parallel, and then the original is transported by the registration rollers 49 and passes through between a reading guide 51 and a reading glass 52. At this time, light from a light source of a first scanning unit 53 is applied to the surface of the original through the reading glass 52; reflected light therefrom enters the first scanning unit 53 through the reading glass 52; the reflected light is guided to an imaging lens 55 by being reflected on mirrors of the first scanning unit 53 and a second scanning unit 54; and the image of the surface of the original is formed on a CCD (Charge Coupled Device) 56 by the imaging lens 55. The CCD 56 reads images on the surface of the original, and outputs image data indicating the image on the surface of the original. Then, the original is transported by transport rollers 57, and discharged to a discharge tray 59 through discharge rollers 58.

An original that is placed on a platen glass 61 can also be read. The registration rollers 49, the reading guide 51, the discharge tray 59 and the like, and members that are above these are integrated into a cover unit that is pivoted at the rear side of the original reading apparatus B to allow opening and closing around an axis along the original transportation direction. By opening this upper side cover unit, the platen glass 61 is opened, and an original can be placed on the platen glass 61. When the original is placed thereon and the cover unit is closed, the surface of the original on the platen glass 61 is exposed to light by the first scanning unit 53 while the first and the second scanning units 53 and 54 are moving in a sub-scanning direction, and the reflected light from the surface of the original is guided to the imaging lens 55 by the first and the second scanning units 53 and 54, thereby forming an image of the surface of the original on the CCD 56 by the imaging lens 55. At this time, the first and the second scanning units 53 and 54 move while maintaining a predetermined speed relationship, and the positional relationship between the first and the second scanning units 53 and 54 is constantly maintained so as not to change the length of the optical path of the reflected light from the surface of the original to the first and the second scanning units 53 and 54, to the imaging lens 55, and to the CCD 56, thereby always accurately maintaining the focus of the image of the surface of the original on the CCD 56.

The entire image of the original thus read is sent to and received by the apparatus main unit A of the image forming apparatus D as image data, and the image is recorded on a recording sheet at the apparatus main unit A.

Meanwhile, the apparatus main unit A of the image forming apparatus D is provided with an exposure apparatus 1, a development apparatus 2 (2*a*, 2*b*, 2*c*, and 2*d*), a photosensitive drum 3 (3*a*, 3*b*, 3*c*, and 3*d*) serving as an image carrier, a charging unit 5 (5*a*, 5*b*, 5*c*, and 5*d*), a cleaner apparatus 4 (4*a*, 4*b*, 4*c*, and 4*d*), an intermediate transfer belt apparatus 8 including an intermediate transfer roller 6 (6*a*, 6*b*, 6*c*, and 6*d*) serving as a transfer unit, a fixing apparatus 12, a sheet transport apparatus 100, a paper feeding tray 10 serving as a paper feeding unit, and a discharge tray 15 serving as a discharge unit.

Image data handled by the apparatus main unit A of the image forming apparatus D is based on color images employing black (K), cyan (C), magenta (M), and yellow (Y), or monochrome images employing a single color (for example, black). Therefore, four of each of the development apparatus 2 (2*a*, 2*b*, 2*c*, and 2*d*), the photosensitive drum 3 (3*a*, 3*b*, 3*c*, and 3*d*), the charging unit 5 (5*a*, 5*b*, 5*c*, and 5*d*), the cleaner apparatus 4 (4*a*, 4*b*, 4*c*, and 4*d*), and the intermediate transfer roller 6 (6*a*, 6*b*, 6*c*, and 6*d*) are provided, corresponding to the respective colors so as to form images of four kinds, wherein regarding the tail end references a to d, a corresponds to black, b to cyan, c to magenta, and d to yellow, thus constituting four image-forming stations. In the following, the tail end references a to d are omitted in the description.

The photosensitive drums 3 are disposed approximately at the mid-level of the apparatus main unit A in the vertical direction.

The charging units 5 are charging means for charging the surfaces of the photosensitive drums 3 uniformly to a predetermined potential and, in addition to roller types or brush types of contact-type charging units, charger-type charging units can be used.

Here, the exposure apparatus 1 is a laser scanning unit (LSU) including a laser diode and reflection mirrors, and exposes the surfaces of the charged photosensitive drums 3 to light in accordance with image data so as to form electrostatic latent images in accordance with the image data on the surfaces of the photosensitive drums.

The development apparatuses 2 develop the electrostatic latent images formed on the photosensitive drums 3 with toners (K, C, M, and Y). The cleaner apparatuses 4 remove and recover the toner that is left on the surfaces of the photosensitive drums 3 after development and image transfer.

The intermediate transfer belt apparatus 8 disposed above the photosensitive drums 3 is provided with, in addition to the intermediate transfer rollers 6, an intermediate transfer belt 7, an intermediate transfer belt drive roller 21, an idler roller 22, a tension roller 23, and an intermediate transfer belt cleaning apparatus 9.

The intermediate transfer belt 7 is stretched across and supported by roller members, such as the intermediate transfer belt drive roller 21, the intermediate transfer rollers 6, and the idler roller 22, and the tension roller 23, which allows the intermediate transfer belt 7 to go around in the predetermined sheet transportation direction (direction of arrow C in the figure).

The intermediate transfer rollers 6 are supported inside the intermediate transfer belt 7 such that the intermediate transfer rollers 6 can rotate, and are pressed against the photosensitive drums 3 with the intermediate transfer belt 7 interposed therebetween.

The intermediate transfer belt 7 is provided so as to contact the respective photosensitive drums 3, and a color toner image (a multicolor toner image) is formed by superimposing the respective toner images on the surfaces of the photosensitive drums 3 and transferring the toner images in order to the intermediate transfer belt 7. This transfer belt 7 is formed as a belt having no end, using a film having a thickness of about 100 μm to 150 μm.

The transfer of the toner image from the photosensitive drums 3 to the intermediate transfer belt 7 is performed by the intermediate transfer rollers 6 that are pressed against the inside (reverse side) of the intermediate transfer belt 7. A high voltage transfer bias (for example, a high voltage of a polarity (+) that is the opposite of the polarity (−) of the charged toner) for transferring the toner image is applied to the intermediate transfer rollers 6. The intermediate transfer rollers 6 are rollers that are based on a metal (for example, stainless steel) shaft having a diameter of 8 to 10 mm and whose surfaces are covered with a conductive elastic material (for example, EPDM, urethane foam, etc.). This conductive elastic material allows a high voltage to be applied uniformly to the recording sheet.

The apparatus main unit A of the image forming apparatus D is further provided with a secondary transfer apparatus 11 including a transfer roller 11*a* serving as a transfer unit. The transfer roller 11*a* is in contact with the outside of the intermediate transfer belt 7.

The toner images on the surfaces of the respective photosensitive drums 3 as described above are laminated on the intermediate transfer belt 7 and become a color toner image of the image data. The laminated toner image of each color is transported with the intermediate transfer belt 7, and transferred onto a recording sheet by the secondary transfer apparatus 11.

The intermediate transfer belt 7 and the transfer roller 11*a* of the secondary transfer apparatus 11 are pressed against each other, forming a nip region. Also, a voltage (for example, a high voltage of a polarity (+) that is the opposite of the polarity (−) of the charged toner) is applied to the transfer roller 11*a* of the secondary transfer apparatus 11 to transfer the toner image of each color on the intermediate transfer belt 7 to the recording sheet. Further, in order to constantly obtain the above nip region, a hard material (such as metal) is used for either the transfer roller 11*a* of the secondary transfer apparatus 11 or the intermediate transfer belt drive roller 21, and a soft material for an elastic roller or the like (such as an elastic rubber roller or a foam resin roller) is used for the other.

Also, toner may sometimes remain on the intermediate transfer belt 7 without the toner images on the intermediate transfer belt 7 being completely transferred onto the recording sheet by the secondary transfer apparatus 11, and this residual toner causes toner color mixing in the next step. Thus, the residual toner is removed and recovered by the intermediate transfer belt cleaning apparatus 9. The intermediate transfer belt cleaning apparatus 9, for example, is provided with a cleaning blade that makes contact with the intermediate transfer belt 7 and can be used as a cleaning member to remove and recover residual toner. The idler roller 22 supports the intermediate transfer belt 7 from inside (reverse side), and the cleaning blade is in contact with the intermediate transfer belt 7, pressing against the idler roller 22 from outside.

The paper feeding tray 10 is a tray for storing recording sheets, and is provided below the image forming portion of the apparatus main unit A. Also, the discharge tray 15, provided above the image forming portion, is a tray in which a recording sheet whose printing has been finished is placed face down.

Also, in the apparatus main unit A, a sheet transport apparatus 100 is provided for feeding a recording sheet in the paper feeding tray 10 through the secondary transfer apparatus 11 and the fixing apparatus 12 to the discharge tray 15. The sheet transport apparatus 100 is provided with an S-shaped sheet transport path S, and transportation members such as a pickup roller 16, a handling roller 14*a*, a separation roller 14*b*, transport rollers 13, pre-registration rollers 19, the registration roller 101, the fixing apparatus 12, and discharge rollers 17 are disposed along the sheet transport path S.

The pickup roller 16 is provided in the downstream side end portion of the paper feeding tray 10 in the sheet transportation direction, and is a pull-in roller that supplies recording sheets one by one from the paper feeding tray 10 to the sheet transport path S. The handling roller 14*a* allows the recording sheet to pass through between the handling roller 14*a* and the separation roller 14*b*, separating and transporting the sheet one by one to the sheet transport path S. The transport rollers 13 and the pre-registration rollers 19 are small rollers for promoting and helping transportation of the recording sheet. The transport rollers 13 are provided at a plurality of positions along the sheet transport path S. The pre-registration rollers 19 are provided at the upstream side of and nearest to the registration roller 101 in the sheet transportation direction, and transport the recording sheet to the registration roller 101.

The leading edge of the recording sheet (downstream side edge in the sheet transportation direction) being transported is put against the registration roller 101 in a stopped state to align the leading edge of the recording sheet, and the registration roller 101 transports the recording sheet with good timing so that the toner image on the intermediate transfer belt 7 is transferred to the recording sheet at the nip region between the intermediate transfer belt 7 and the secondary transfer apparatus 11 in synchronization with the toner image formed on the intermediate transfer belt 7. For example, the registration roller 101 transports the recording sheet such that the toner image on the intermediate transfer belt 7 matches the image forming position on the recording sheet in the nip region between the intermediate transfer belt 7 and the secondary transfer apparatus 11. The operation of sheet transportation is described later in detail.

The fixing apparatus 12 receives the recording sheet to which the toner image has been transferred, and transports the recording sheet by sandwiching the sheet between a heat roller 31 and a pressure roller 32.

The heat roller 31 is temperature-controlled so as to be at a predetermined fixing temperature, and has the functions of melting, mixing, and pressing toner images transferred onto the recording sheet so that the images are thermally fixed onto the recording sheet by subjecting the recording sheet to thermocompression bonding in cooperation with the pressure roller 32.

The recording sheet on which the multicolor toner images are fixed is discharged onto the discharge tray 15 by the discharge rollers 17.

It is also possible to form a monochrome image by using only a single image-forming station out of the four, and transferring the monochrome image to the intermediate transfer belt 7 of the intermediate transfer belt apparatus 8. Such a monochrome image is also transferred from the intermediate transfer belt 7 to the recording sheet, as in the case with color images, and fixed onto the recording sheet.

Furthermore, when image forming is to be performed on not only the front face but both faces of the recording sheet, after fixing the image on the front face of the recording sheet with the fixing apparatus 12, during the transportation of the recording sheet by the discharge rollers 17 in the sheet transport path S, the discharge rollers 17 are stopped and then rotated in reverse; the recording sheet is passed into a reverse path Sr; the recording sheet is turned over so as to reverse the front and reverse faces; the recording sheet is guided again to the registration roller 101; images are recorded and fixed onto the reverse face of the recording sheet as in the case with the front face of the recording sheet; and the recording sheet is discharged to the discharge tray 15.

Meanwhile, a curved portion 71 of the sheet transport path S being curved with a predetermined curvature is formed at an upstream side of the registration roller 101 in the sheet transportation direction.

Figure 2:
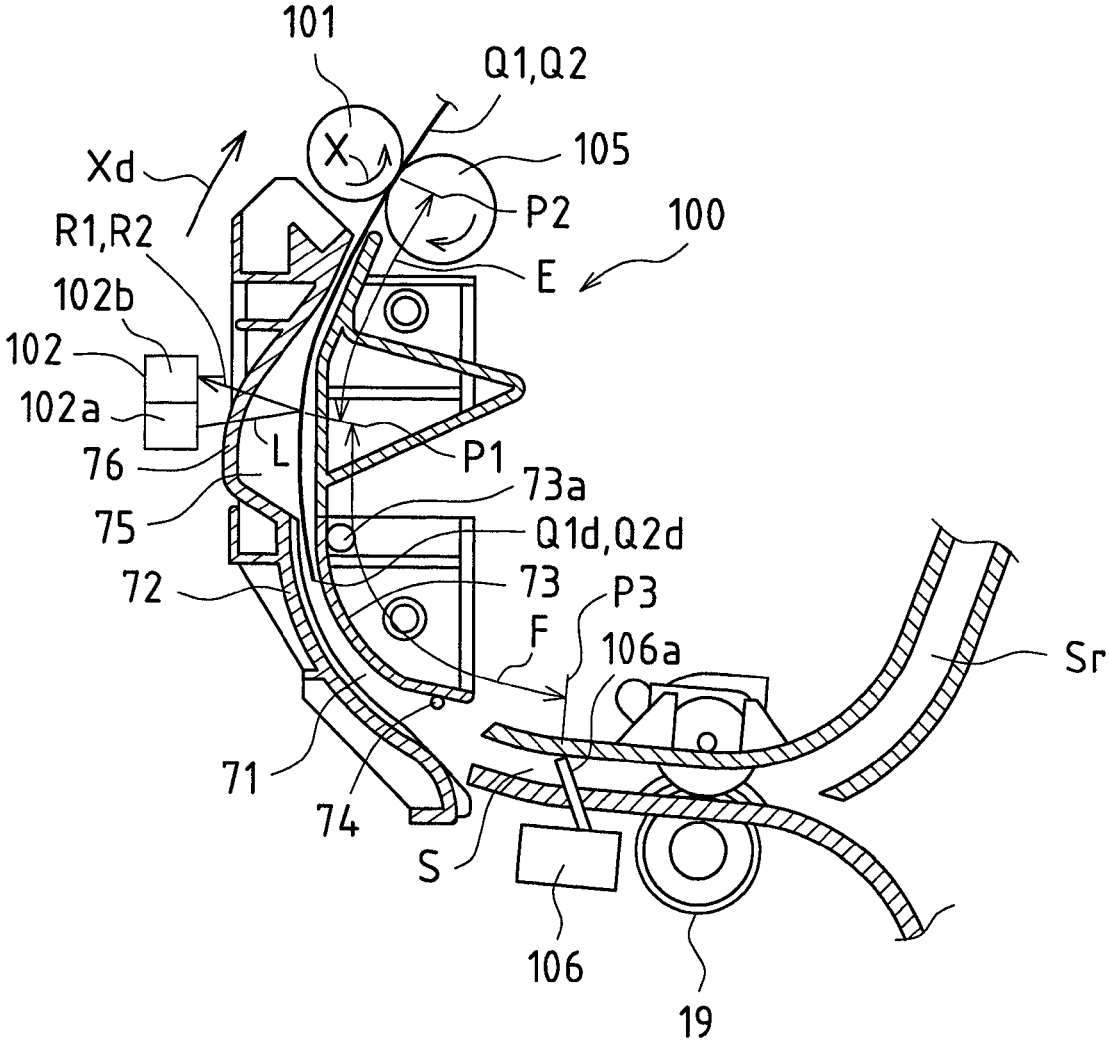
FIG. 2 is a cross-sectional view illustrating the proximity of a curved portion of a sheet transport path in the sheet transport apparatus of FIG. 1.

FIG. 2 is a cross-sectional view schematically illustrating the proximity of the curved portion 71 of the sheet transport path S in the sheet transport apparatus 100 shown in FIG. 1.

As shown in FIG. 2, the curved portion 71 of the sheet transport path S is formed between an outer guide 72 and an inner guide 73, and positioned at an upstream side of the registration roller 101 and at a downstream side of the pre-registration rollers 19 in a predetermined sheet transportation direction (direction of arrow Xd in the figure).

The outer guide 72 is fixed. The inner guide 73 is supported so as to be swingable around a pivot axis 73*a* along the axial direction of the registration roller 101. The end portion at a side opposite the pivot axis 73*a* side of the inner guide 73 abuts a stopper 74 due to its own weight rotating around the pivot axis 73*a*, thereby restricting the rotation to the sheet transport path S side and positioning itself. The stopper 74 is fixed on the apparatus main unit A at a position that does not contact or interfere with the recording sheets Q1 and Q2 that pass through the curved portion 71.

Also, a sheet flection forming portion (space) 75 for reliably flexing the recording sheets Q1 and Q2 by abutting the leading edge of the recording sheets Q1 and Q2 so as to be parallel to the registration roller 101 is provided in the sheet transport path S. The sheet flection forming portion 75 is provided at an upstream side of and in the proximity of the registration roller 101 in the sheet transportation direction Xd, so that a section 76 of the outer guide 72 in the sheet transport path S is depressed outwardly like a recess when viewed in a cross section (cross sectional view). In other words, the sheet flection forming portion 75 is provided at an upstream side of and in the proximity of the registration roller 101 in the sheet transportation direction Xd, outwardly widening the width of the sheet transport path S so as to accommodate the recording sheets Q1 and Q2 that are pressed against the registration roller 101 in a stopped state and flexed.

Then, a reflective optical sensor 102, i.e., an example of a first optical sensor, is provided outside the sheet flection forming portion 75. Also, at an upstream side of the reflective optical sensor 102 in the sheet transportation direction Xd in the sheet transport path S, a detection sensor 106, i.e., an example of a second sensor, is provided. Here, the detection sensor 106 is provided in the proximity of the pre-registration rollers 19. At the sheet flection forming portion 75, an optically-transparent window (not shown) is provided for applying the outgoing light L from the reflective optical sensor 102 onto the sheets Q1 and Q2 and receiving the reflected light R1 and R2 from the sheets Q1 and Q2 at the reflective optical sensor 102. Also, at a guide member in the proximity of the pre-registration rollers 19, an opening (not shown) from which a lever 106*a* of the detection sensor 106 projects is provided.

Figure 3:
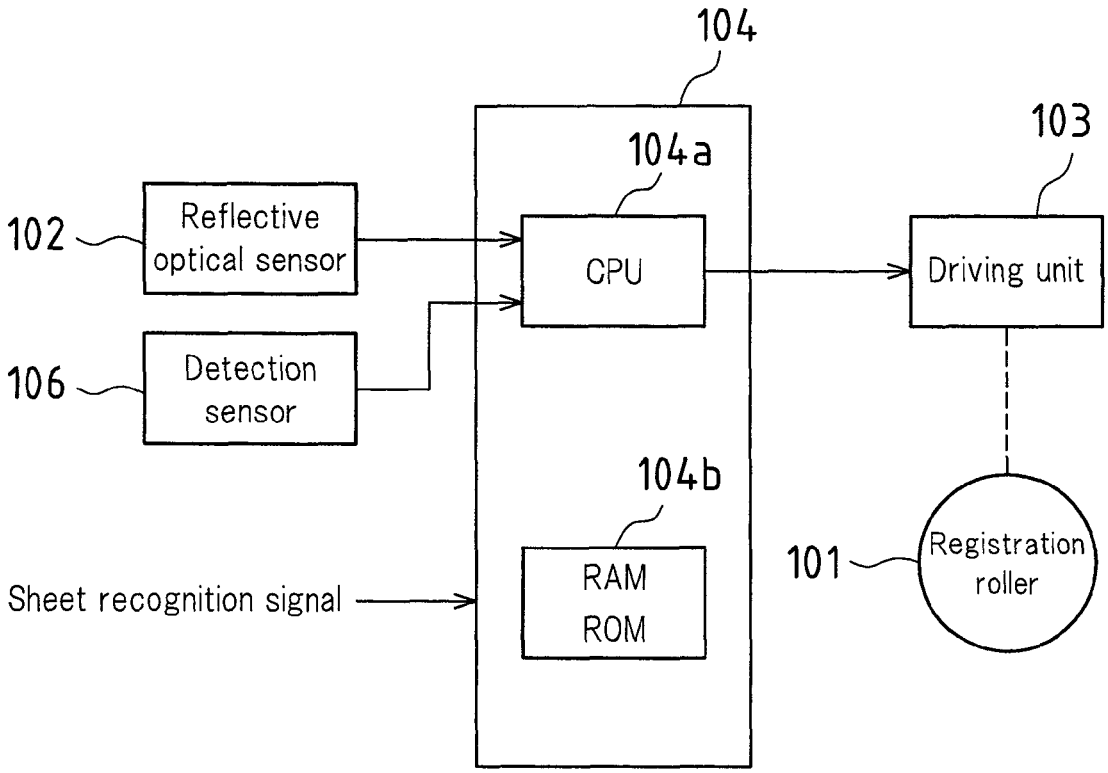
FIG. 3 is a system block diagram of a control system of the image forming apparatus.

FIG. 3 is a system block diagram of a control system of the image forming apparatus D. The image forming apparatus D is further provided with a control unit 104.

As shown in FIG. 3, the control unit 104 is provided with a processing unit 104*a* such as a CPU, and a memory unit 104*b* including memories such as a ROM and a RAM. To be specific, the image forming apparatus D controls various constituent members by causing the CPU in the processing unit 104*a* to load and execute control programs stored in advance in the ROM of the memory unit 104*b* into the RAM of the memory unit 104*b*.

The control unit 104 also functions as a sheet transportation control unit of the sheet transport apparatus 100 according to an embodiment of the present invention.

DESCRIPTION OF CHARACTERISTIC ASPECTS OF THE PRESENT INVENTION

Figure 6A:
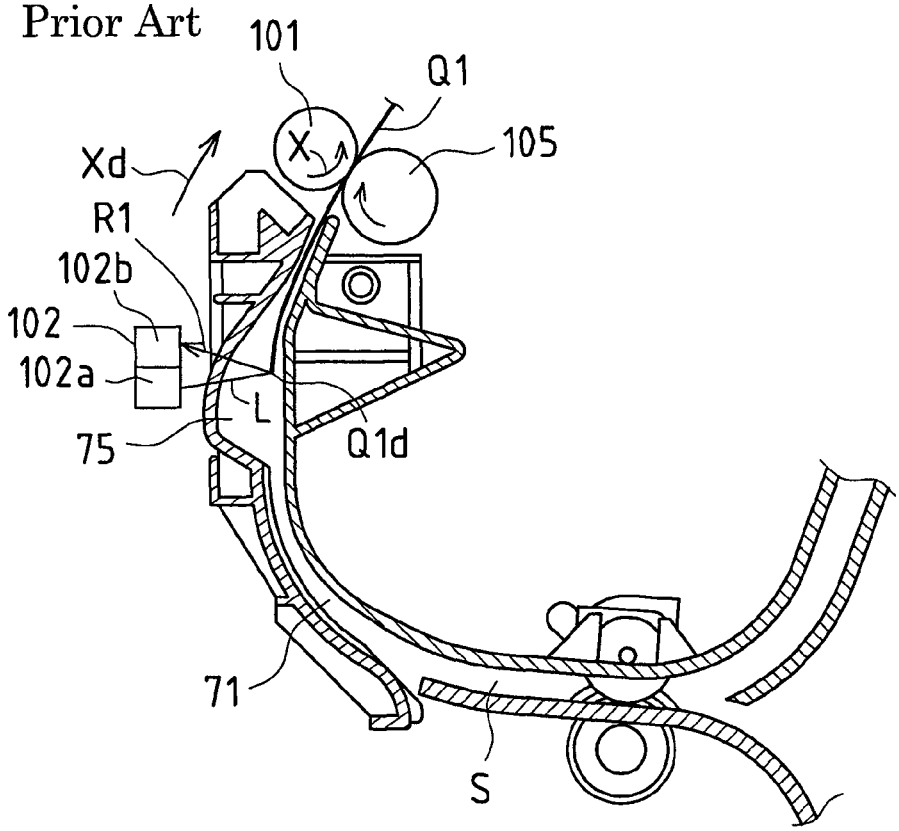
FIG.6A Prior Art
FIGS. 6A and 6B are diagrams illustrating inconveniences in the case where a reflective optical sensor is used in a conventional sheet transport apparatus provided with a sheet transport path that is curved at an upstream side of the registration roller in the sheet transportation direction.
Figure 6B:
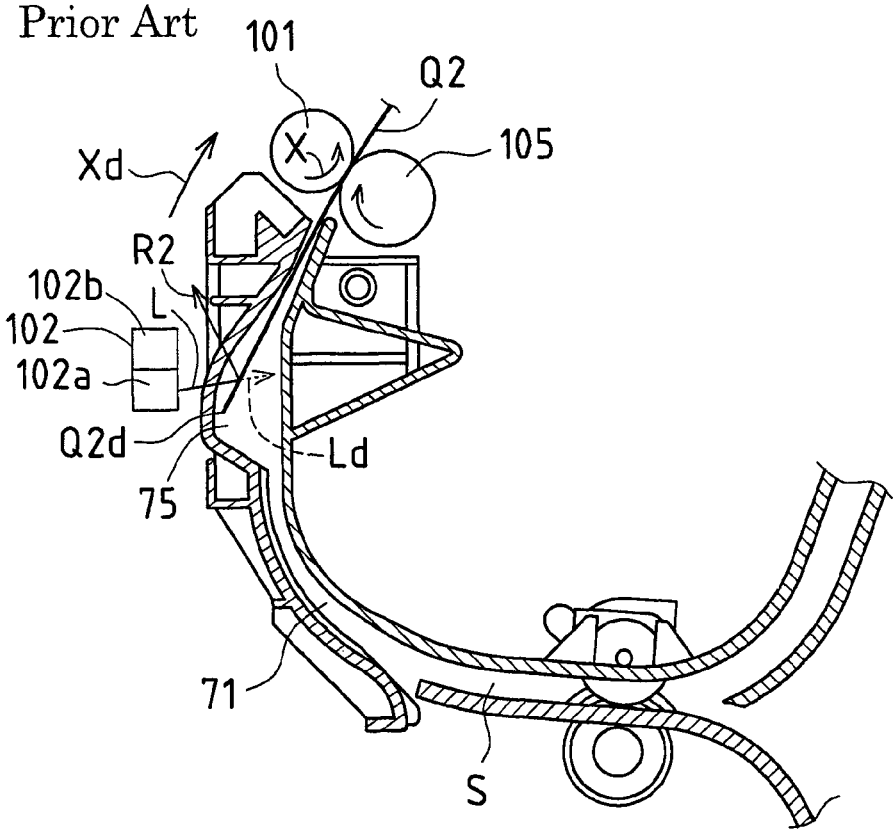
FIG.6B Prior Art

The sheet transport apparatus 100 according to an embodiment of the present invention is provided with a registration roller 101, a sheet transport path S, a reflective optical sensor 102, a detection sensor 106, a driving unit 103 that drives the registration roller 101 so that the registration roller 101 rotates in a sheet transportation direction X, and a control unit 104 (an example of a sheet transportation control unit). The driving unit 103 is electrically connected to an output system of the control unit 104 so that an operation signal can be inputted, and is driven while the operation signal is being inputted. The reflective optical sensor 102 and the like are similar to those in the above-described conventional sheet transport apparatus shown in FIGS. 6A and 6B, and detailed descriptions thereof are omitted.

In this embodiment, the detection sensor 106 is a mechanical detection sensor including a lever 106*a* that is turned on and off depending on the presence or absence of a sheet.

To be specific, the detection sensor 106 can be at a first position, in which the lever 106*a* obstructs the sheet transport path S when the recording sheets Q1 and Q2 are not present, and a second position, in which the lever 106*a* is pressed down by the recording sheets Q1 and Q2 passing through the sheet transport path S and withdrawn from the sheet transport path S when the recording sheets Q1 and Q2 are present. The detection sensor 106 is not limited to such a mechanical detection sensor, and when the detection sensor is disposed at a position where the trailing edge of the OHP sheet does not easily flips up as in the example shown in FIG. 2, for example, an optical detection sensor may be used.

The reflective optical sensor 102 and the detection sensor 106 are electrically connected to an input system of the control unit 104; and when the recording sheets Q1 and Q2 are not present, a sheet-absent signal is outputted to the control unit 104, and when the recording sheets Q1 and Q2 are present, a sheet-present signal is outputted to the control unit 104.

The control unit 104 can perform leading edge detection, i.e., sheet-present detection of a sheet-present state following sheet-absent detection of a sheet-absent state; of the recording sheets Q1 and Q2 using the reflective optical sensor 102 or the detection sensor 106. For example, the control unit 104 temporarily stops rotational driving of the pre-registration rollers 19 based on a leading edge timing signal of the recording sheets Q1 and Q2 from the reflective optical sensor 102 or the detection sensor 106, after an elapse of a predetermined time from detection of the leading edge of the recording sheets Q1 and Q2 (that is, immediately before the registration roller 101 in a stopped state, or at a time when the recording sheets Q1 and Q2 that are pressed against the registration roller 101 in a stopped state are appropriately flexed at the sheet flection forming portion 75). Furthermore, the control unit 104 rotationally drives the registration roller 101 after an elapse of a predetermined time (that is, at the time of image forming, when rotational driving of the pre-registration rollers 19 is restarted and the recording sheets Q1 and Q2 that are in a state of being flexed by a leading edge being pressed against the registration roller 101 in a stopped state are synchronized with the toner image formed on the intermediate transfer belt 7, or at the time of image forming, when the recording sheets Q1 and Q2 that are in a state of being flexed by a leading edge being pressed against the registration roller 101 in a stopped state are synchronized with the toner image formed on the intermediate transfer belt 7).

Furthermore, the control unit 104 is provided with a plain paper transportation mode in which plain paper Q1 is transported, and an OHP transportation mode in which OHP sheet Q2 is transported. The control unit 104 is configured so that, after the registration roller 101 is rotationally driven by the driving unit 103, when in the plain paper transportation mode (when a sheet recognition signal corresponding to plain paper is inputted), the rotational driving of the registration roller 101 by the driving unit 103 is temporarily stopped so as to be ready to transport the next sheet after an elapse of a predetermined transportation time from detection by the reflective optical sensor 102 of sheet-absent detection (after detection determining the trailing edge Q1*d* of the plain paper Q1) following sheet-present detection of the plain paper Q1 transported by the registration roller 101.

Furthermore, the control unit 104 is configured so that, when in the OHP sheet transportation mode (when a sheet recognition signal corresponding to the OHP sheet is inputted), control of detection by the reflective optical sensor 102 of sheet absence following sheet presence (detection determining the trailing edge Q2*d* of the OHP sheet Q2) of the OHP sheet Q2 transported by the registration roller 101 is not performed (here, not determined), while in a predetermined detection restricted time after sheet detection by the detection sensor 106 of the OHP sheet Q2 transported by the registration roller 101 (here, after detection of the trailing edge, i.e., sheet absence following sheet presence), and the rotational driving of the registration roller 101 by the driving unit 103 is temporarily stopped after the elapse of the transportation time from the elapse of the detection restricted time so as to be ready to transport the next sheet. The detection restricted time is the time from after sheet detection by the detection sensor 106 (here, after detection of the trailing edge of the OHP sheet Q2) until the time when the trailing edge of the sheet reaches the position where it is detected by the reflective optical sensor 102. When a sheet is being detected as present by the reflective optical sensor 102 even after the elapse of the detection restricted time, the control unit 104 determines that a transportation malfunction such as a jam or the like has occurred, stops the apparatus operation, and notifies the user of the malfunction.

FIGS. 4A to 4G are timing charts illustrating detection timings for the recording sheets Q1 and Q2 by the reflective optical sensor 102 and the detection sensor 106, a start/stop timing for the rotational driving of the registration roller 101, and transportation timings for the recording sheets Q1 and Q2 by the registration roller 101 of the sheet transport apparatus 100 according to an embodiment of the present invention. FIGS. 4A to 4C illustrate timing charts for the case where a plain paper Q1 is transported, and FIGS. 4D to 4G illustrate timing charts for the case where an OHP sheet Q2 is transported. The "detection sensor ON" and "detection sensor OFF" in FIG. 4G illustrate a "present-detection state" and an "absent-detection state" for the OHP sheet Q2 by the detection sensor 106, respectively. Furthermore, in FIGS. 4D to 4G, the oblique line area indicates a region of a detection restricted time Ts2 in which the control of detection determining the trailing edge Q2*d* of the OHP sheet Q2 is not performed.

A transportation time Ts1 of the sheets Q1 and Q2 shown in FIGS. 4A to 4G is set in advance based on the following computation formula (1).

$$[\text{Transportation time } Ts1]=[\text{First post-detection transportation distance } E]/[\text{transportation speed } V] \quad \text{formula (1)}$$

The first post-detection transportation distance E (ref: FIG. 2) is the distance from a detection position P1 of the reflective optical sensor 102 to a sandwich position P2 between the registration roller 101 and the facing roller 105, and the transportation speed V is the transportation speed of a sheet.

Meanwhile, a predetermined detection restricted time Ts2 after detection of the trailing edge of the OHP sheet Q2 by the detection sensor 106 shown in FIGS. 4D to 4G is set in advance based on the following computation formula (2).

$$[\text{Detection restricted time } Ts2]=[\text{Second post-detection transportation distance } F]/[\text{Transportation speed } V] \quad \text{formula (2)}$$

The second post-detection transportation distance F (ref: FIG. 2) is the distance from a detection position P3 of the detection sensor 106 to the detection position P1 of the reflective optical sensor 102, and the transportation speed V is the transportation speed of the sheet.

(Processing Operation of Control Unit 104)

Figure 5:
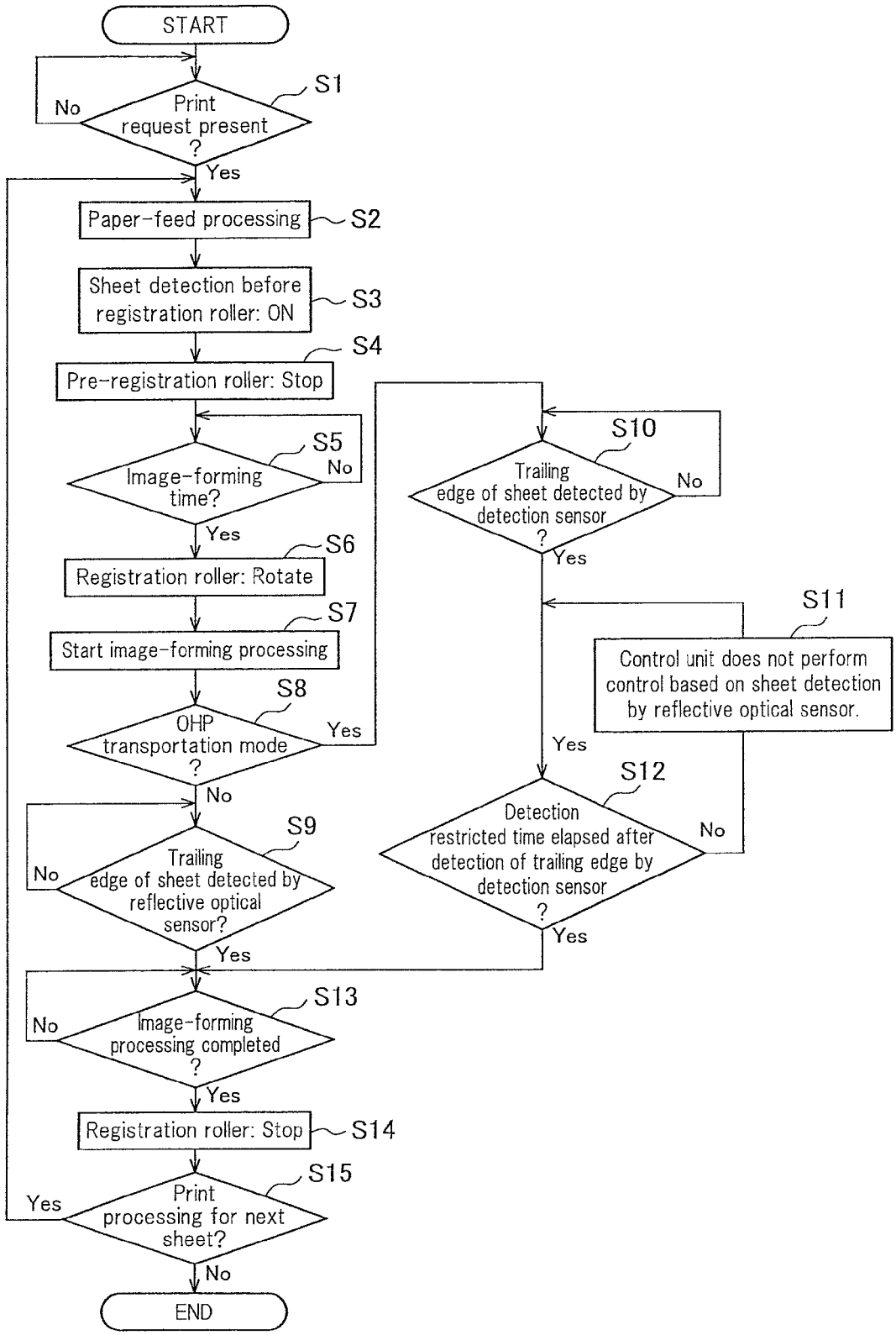
FIG. 5 is a flowchart illustrating a print operation of the image forming apparatus.

Next, the processing procedures of the control unit 104 in the image forming apparatus D are described with reference to FIG. 5. FIG. 5 is a flowchart illustrating the print operation of the image forming apparatus D.

When a print operation is to be performed, as shown in FIG. 5, the image forming apparatus D waits until there is a print request (step S1). At this time, the registration roller 101 is in a stopped state. When there is a print request (Step S1: Yes), paper-feed processing is executed, thereby transporting the recording sheets Q1 and Q2 from the paper feeding tray 10 to the sheet transport path S (Step S2).

Next, a leading edge of the recording sheets Q1 and Q2 is detected by the reflective optical sensor 102 or the detection sensor 106 (Step S3). After an elapse of a predetermined time from the detection of a leading edge of the recording sheets Q1 and Q2, the rotational driving of the pre-registration rollers 19 is stopped (Step S4). Next, the system waits the image-forming time for synchronizing with the toner image formed on the intermediate transfer belt 7 (Step S5: No), and at the image-forming time (Step S5: Yes), the registration roller 101 is rotationally driven (Step S6), and image-forming processing is started (Step S7).

Then, it is determined whether or not the current mode is the OHP transportation mode (that is, a sheet recognition signal corresponding to the OHP sheet is inputted, or a sheet recognition signal corresponding to the plain paper is inputted) (Step S8), and when the mode is not the OHP transportation mode (that is, when in the plain paper transportation mode) (Step S8: No), it is determined whether or not the trailing edge of the plain paper Q1 is detected by the reflective optical sensor 102, i.e., detection of sheet absence following sheet presence (Step S9), and the process moves to Step S13 when the trailing edge is detected (Step S9: Yes).

On the other hand, when in the OHP transportation mode (Step S8: Yes), it is determined whether or not the trailing edge of the OHP sheet Q2 is detected by the detection sensor 106, i.e., detection of sheet absence following sheet presence (Step S10), and when the trailing edge is detected (Step S10: Yes), but within the detection restricted time Ts2 from the detection of the trailing edge of the OHP sheet Q2 by the detection sensor 106 (Step S12: No), the detection of the trailing edge by the reflective optical sensor 102 is ignored (Step S11), and the process moves to Step S13 after the elapse of the detection restricted time Ts2 (Step S12: Yes).

Next, it is determined whether or not the image-forming processing has been completed (Step S13), and when the image-forming processing has been completed (Step S13: Yes), in the case of the plain paper transportation mode, the rotational driving of the registration roller 101 is stopped after an elapse of the transportation time Ts1 from the detection of "reflective optical sensor OFF" by the reflective optical sensor 102 (ref: FIGS. 4A to 4C) (Step S14), and in the case of the OHP transportation mode, the rotational driving of the registration roller 101 is stopped after the elapse of the transportation time Ts1 following the elapse of the detection restricted time Ts2 after "detection sensor OFF" is detected by the detection sensor 106 (ref: FIGS. 4D to 4G) (Step S14), and whether or not print processing for a next recording sheet Q is to be performed (Step S15) is determined. When print processing is to be performed for a next recording sheet Q (Step S15: Yes), the process moves to step S2, whereas when print processing is not to be performed for a next recording sheet Q (step S15: No), the processing ends.

With the above-described sheet transport apparatus 100, when transporting the plain paper Q1, as shown in FIGS. 4A to 4C, rotational driving of the registration roller 101 is stopped after the plain paper Q1 is transported by the registration roller 101 (after the trailing edge Q1*d* of the plain paper Q1 has passed through the registration roller 101) (ref:

α1 in FIGS. 4A to 4C). On the other hand, when the OHP sheet Q2 is transported, as shown in FIGS. 4D to 4G, even if the reflective optical sensor 102 falsely detects the trailing edge Q2*d* of the OHP sheet Q2 within the detection restricted time Ts2 after the detection of the trailing edge of the OHP sheet Q2 by the detection sensor 106 (time in which false detection possibly occur) (ref the oblique line area in FIGS. 4D to 4G), because control of the trailing edge detection by the reflective optical sensor 102, i.e., sheet absence following sheet presence (detection determining the trailing edge Q2*d* of the OHP sheet Q2), is not performed (here, not determined), false detection by the reflective optical sensor 102, i.e., detecting that the trailing edge Q2*d* of the OHP sheet Q2 has passed through before the trailing edge actually passes through (detecting at a time earlier than the detection time for the plain paper) can be ignored (masked). Then, after the elapse of the detection restricted time Ts2, and further after the elapse of the transportation time Ts1, that is, after the OHP sheet Q2 is transported by the registration roller 101 (after the trailing edge Q2*d* of the OHP sheet Q2 has passed through the registration roller 101), the rotational driving of the registration roller 101 can be stopped (ref: α2 in FIGS. 4D to 4G).

As described above, with the sheet transport apparatus 100 according to an embodiment of the present invention, because control of the detection of the trailing edge of the OHP sheet Q2 by the reflective optical sensor 102 is not performed when in the detection restricted time Ts2, stopping of the driving of the registration roller 101 while the registration roller 101 is still transporting the OHP sheet Q2 can be prevented, and image defects such as dislocated transfer can be avoided.

Although a reflective optical sensor is used as the optical sensor of the sheet transport apparatus 100 according to an embodiment of the present invention, the optical sensor is not limited thereto, and a transmissive optical sensor can also be used. Also, although the sheet transport apparatus used in this embodiment is a sheet transport apparatus that is applied to a main unit of an image forming apparatus and transports recording sheets, the sheet transport apparatus is not limited thereto, and for example, the sheet transport apparatus may be applied to the original reading apparatus of the image forming apparatus and transport original sheets.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A sheet transport apparatus comprising:
- a registration roller that transports a sheet in a predetermined sheet transportation direction,
- a sheet transport path including a curved portion that is curved at an upstream side of the registration roller in the sheet transportation direction,
- a first optical sensor that detects presence or absence of a sheet at the curved portion of the sheet transport path,
- a second sensor that detects presence or absence of a sheet at an upstream side of the first optical sensor in the sheet transportation direction, and
- a sheet transportation control unit that stops driving of the registration roller after an elapse of a predetermined transportation time from detection by the first optical sensor of sheet absence following sheet presence of a sheet transported by the registration roller,
- wherein upon predetermined sheet detection by the second sensor, the sheet transportation control unit does not perform control based on sheet detection by the first optical sensor during a predetermined detection restricted time Ts2 following the predetermined sheet detection by the second sensor when the sheet is of a specific type.

2. The sheet transport apparatus according to claim 1, wherein the predetermined sheet detection by the second sensor is detection of sheet absence following sheet presence by the second sensor.

3. An image forming apparatus comprising the sheet transport apparatus according to claim 1.

4. An image forming apparatus comprising the sheet transport apparatus according to claim 2.

* * * * *